US009254003B2

(12) United States Patent
Virga et al.

(10) Patent No.: US 9,254,003 B2
(45) Date of Patent: Feb. 9, 2016

(54) ENCLOSED SMOKING DEVICE

(71) Applicants: Anthony Virga, Novi, MI (US); Mitchell Schikora, Walled Lake, MI (US)

(72) Inventors: Anthony Virga, Novi, MI (US); Mitchell Schikora, Walled Lake, MI (US)

(73) Assignee: HK Industries LLC, Novi, MI (US)

( * ) Notice: Subject to any disclaimer, the term of this patent is extended or adjusted under 35 U.S.C. 154(b) by 665 days.

(21) Appl. No.: 13/708,047

(22) Filed: Dec. 7, 2012

(65) Prior Publication Data

US 2013/0146074 A1 Jun. 13, 2013

Related U.S. Application Data

(60) Provisional application No. 61/567,747, filed on Dec. 7, 2011.

(51) Int. Cl.
*A24F 1/24* (2006.01)

(52) U.S. Cl.
CPC ..... *A24F 1/24* (2013.01)

(58) Field of Classification Search
None
See application file for complete search history.

(56) References Cited

U.S. PATENT DOCUMENTS 1,049,440 A * 1/1913 Banks ..... A24F 1/24 131/193
1,948,649 A * 2/1934 Dabney ..... A24F 1/24 131/193

* cited by examiner

*Primary Examiner* — Michael J Felton
(74) *Attorney, Agent, or Firm* — Kohn & Associates, PLLC

(57) ABSTRACT

An enclosed smoking device including a dome sealingly engageable with a base member, and a solid bowl sealingly engageable with a socket extending through the base member, the bowl being heatable from the exterior of the device. The assembly of dome, base member, and bowl define an enclosed interior space to prevent the escape of smoke or vapor produced by the heating of a smokable material in the bowl. The dome further includes a choke and a non-projecting integrated mouthpiece. A method of using an enclosed smoking device wherein no smoke or vapor is permitted to escape from the device during the smoking operation.

19 Claims, 2 Drawing Sheets

ENCLOSED SMOKING DEVICE

TECHNICAL FIELD

The present invention relates to pipes and other smoking devices for igniting or heating smokable materials such as tobacco, and for conducting the resulting smoke to a user. More particularly, the present invention relates to enclosed smoking devices that prevent the escape of smoke into the atmosphere.

BACKGROUND OF THE INVENTION

Pipes and other devices for the smoking of materials such as tobacco, essential oils, and the like are well known. They typically include an open bowl to contain the smokable material. The bowl communicates with a hollow projecting stem or tube that terminates in a mouthpiece. Hookahs and the like employ variants of this design wherein an air or water filled cooling chamber intervenes at some location between bowl and mouthpiece.

A shortcoming of prior smoking devices is the escape of smoke or vapor from the device into the surrounding atmosphere. This escape causes both the waste of material and the unintentional exposure of nearby individuals to smoke that they do not desire. The escape of smoke is not prevented by prior art devices, which at best provide only partial isolation of the source of smoke from the atmosphere during the smoking process.

U.S. Pat. No. 5,678,573 to Aldin and U.S. Pat. No. 4,253,252 to Bianchino disclose smoking pipes including a bowl which can be sealed off at its upper end by a lid or cap. This feature does not isolate the source of smoke from the atmosphere, because the bottom of the bowl is always open to the atmosphere, being occluded only by an open screen or mesh upon which the smokable material rests. The open bottom is necessary to allow the application of flame to the smokable material, and to allow a continuous draft to pass through the material during inhalation. U.S. Pat. No. 7,905,236 to Bryman et al. discloses a bowl that is closed at its lower end and sealable with a slidable cover at its upper end, but is operable only when the slidable cover is open, the closed condition being useful only for storage.

Another shortcoming of prior smoking devices is the inclusion of projecting stems or mouthpieces. These structures are easily damaged or broken when the device is transported. The devices disclosed by Aldin, Bianchino, and Bryman et al., discussed above, all feature projecting stems or mouthpieces. U.S. Pat. No. 4,165,753 to Stryker discloses a smoking device with a non-projecting mouthpiece that is essentially an aperture in a smoke-receiving box, but does not disclose a device that completely isolates the source of smoke from the atmosphere.

There is therefore a need for a smoking device which isolates a source of smoke or vapor from the atmosphere during a smoking operation, and which features a nonprojecting, integrated mouthpiece.

SUMMARY OF THE INVENTION

The present invention provides an enclosed smoking device including a base member with a socket extending therethrough; a bowl having a solid bottom including an upper surface and a lower surface, the bowl being sealingly engageable with the socket with the lower surface of the bowl exposed to the atmosphere; and a dome sealingly engageable with the base member, the dome including a mouthpiece. The base member, the upper surface of the bowl, and the dome define an enclosed interior space isolated from the atmosphere.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1A:
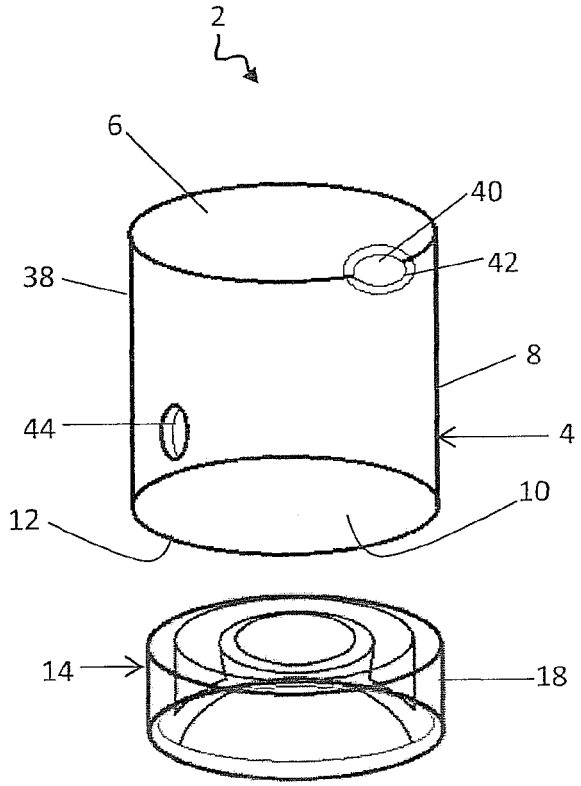
FIG. 1A shows an exploded view of the dome and base member of a smoking device according to the present invention.
Figure 1B:
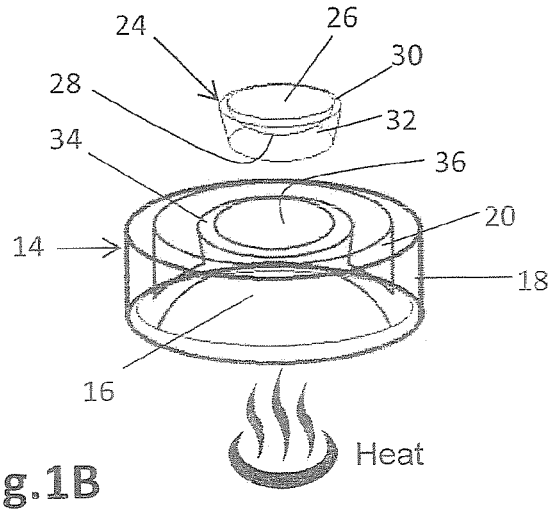
FIG. 1B shows an exploded view of the base member and bowl of the smoking device.
Figure 1C:
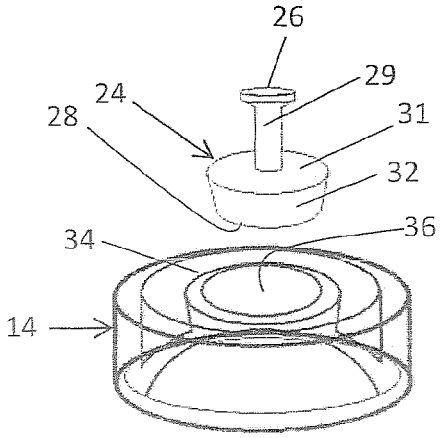
FIG. 1C shows an exploded view of base member and an alternative embodiment of the bowl of the smoking device.
Figure 2A:
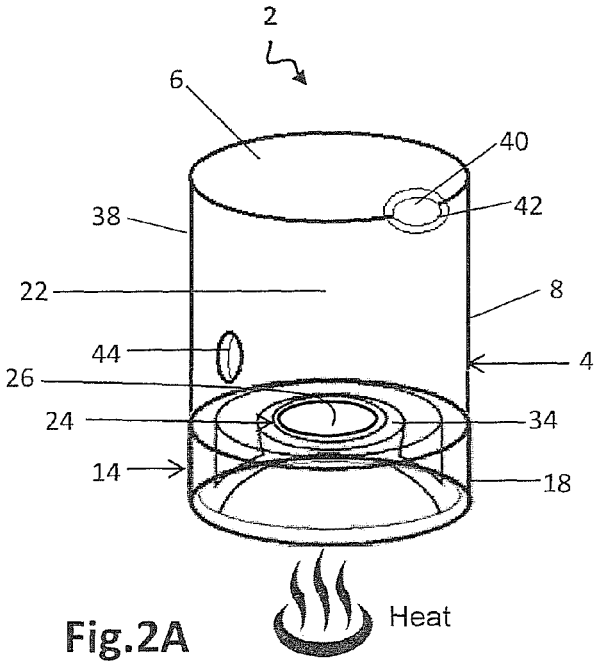
FIG. 2A shows a perspective elevation of an assembled smoking device according to the present invention.
Figure 2B:
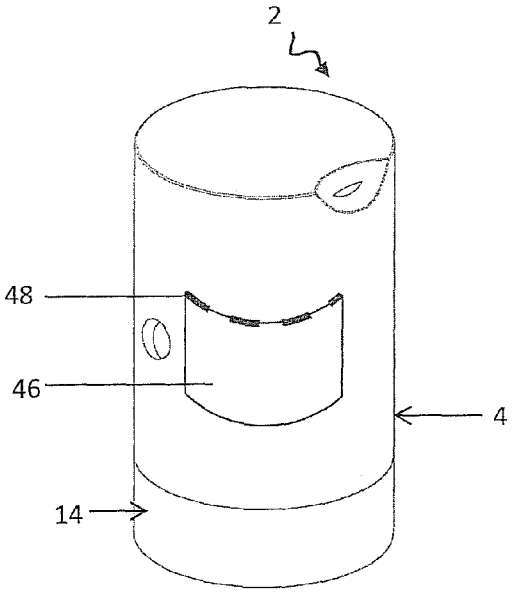
FIG. 2B shows a perspective elevation of an embodiment of the smoking device including a dome including a sealable hatch.

A smoking device according to the present invention is generally shown at 2 in FIGS. 1 and 2. In a preferred embodiment, the device 2 includes a cylindrical dome 4 having a generally flat top wall 6, at least one side wall 8, and an open end 10 defined by a rim 12 opposite the top wall 6, as best seen in FIG. 1A. The open end 10 of the dome 4 is engageable to a generally concave base member 14. The base member 14 includes a bottom wall 16, at least one lateral wall 18 extending upwardly therefrom, the lateral wall 18 terminating in a ledge 20, which is sealably engageable to the rim 12 of the dome 4. Upon assembly of the device 2, with the dome 4 engaged to the base member 14, the combination of dome 4 and base member 14 define an enclosed interior space 22, as best seen in FIG. 2A.

The base member includes a solid bottomed bowl 24, to support a smokable material and to serve as the source of smoke or vapors. The bowl 24, which is preferably circular, includes an upper surface 26, a lower surface 28, and a lateral wall 30, which extends downward below the lower surface 28 of the bowl 24 to form a circumferential collar 32, best seen in FIG. 1B. The collar 32 is sealingly engageable with a complementary socket 34 defined by a bore 36 extending entirely through the base member 14. Preferably the center of the socket 34 is coaxial with the center of the bottom wall 16 of the base member 14. In order to provide clearance for the lower portion of the collar 32, the bottom wall 16 of the base member 14 is preferably parabolic, rising upward towards its center, with the socket 34 situated at the apex of the parabola.

In an alternative embodiment, the lateral wall 30 of the bowl 24 extends upward to form a column 29 to elevate the upper surface 26 of the bowl 24 above the base member 14. The circumference of the column 29 can be smaller than the circumference of the collar 32, with the lateral wall 30 of the bowl 24 being inwardly inflected to form a pedestal 31, as shown in FIG. 1C.

With the bowl 24 inserted into the socket 34, and the dome 4 engaged to the base member 14, the lower surface 28 of the bowl 24 is exposed to the atmosphere, and the upper surface 26 of the bowl 24 is exposed to the interior space 22 of the smoking device 2, and is isolated from the atmosphere by the sealing engagement of the collar 32 with the socket 34. In use, a smokable material placed upon the upper surface 26 of the bowl 24 is heated or ignited by heat applied to the lower surface 28 of the bowl 24, and the resulting smoke or vapor is contained by the enclosed interior space 22 until it is inhaled by a user.

The dome 4 and base member 14 are preferably of shapes sufficiently similar to promote their close mutual engagement. In the preferred embodiment, as illustrated in FIG. 1A, the dome 4 is a cylinder including a flat, closed upper end 38 and a circumferential side wall 8 extending downward to end in a rim 12, and the base member 14 includes a round lateral wall 18 having a diameter similar to that of the rim 12. Alternatively, the dome 4 and base member 14 can have circumferences that describe polygons, for example triangles, rectangles, and pentangles defined by, respectively, three, four, or five side walls 8 of the dome 4 and three, four, or five lateral walls 18 of the base member 14 (not shown). The dome 4 can alternatively be a truncated sphere (not shown) with a rim 12 similar in diameter to that the lateral wall 18 of a round base member 14.

The dome 4 includes a mouthpiece, which is preferably a non-projecting, integrated mouthpiece 40. That is, the mouthpiece 40 is an aperture defined in the dome 4, preferably an ovoid aperture situated at the vertex between the top wall 6 and at least one side wall 8 of the dome 4. This situation of mouthpiece 40 allows a user to place one lip on the top wall 6 and the opposite lip on a side wall 8 to create a comfortable air tight seal around the mouthpiece 40. The mouthpiece 40 can optionally be surrounded by one or more slightly raised lobes 42 projecting from the dome. The lobes 42 can be integral to the dome surface or applied to the dome surface. Alternatively, the mouthpiece 40 can be surrounded by one or more applied soft cushions (not shown) similarly situated to the lobes 42. The lobes 42 or cushions enhance the tightness and comfort of fit. The non-projecting integrated mouthpiece 40 improves the transportability of the smoking device 2 and eliminates the risk of breakage during transport engendered by a conventional projecting mouthpiece. Less preferably, the device can include a projecting mouthpiece (not shown).

The dome 4 preferably includes a choke 44, that is, an opening to permit the admission of air during the inhalation of smoke by a user, thus equalizing interior and exterior pressure and permitting an easy draw. The choke 44 can be defined at any convenient point in a side wall 8 of the dome 4, preferably at a point opposite the mouthpiece 40. The choke 44 is preferably round or oval and of a diameter that permits its complete occlusion by a single fingertip of a user. The choke 44 can optionally be occluded with a flap or cover (not shown) attached to the exterior of a side wall 8 at appropriate proximity to the choke 44.

Optionally, a source of heat can be applied directly to a smokable material by extending the source of heat through the choke 44 towards the upper surface 26 of the bowl 24 (not shown). The source of heat is applied until sufficient smoke or vapor is produced. The source of heat is then withdrawn and the choke 44 is operated as previously described. An embodiment of the bowl 24 wherein the upper surface 26 of the bowl 24 is elevated by a column 29 is particularly favorable to direct application of heat to a smokable material.

The dome 4 and base member 14 are preferably constructed of a transparent polycarbonate such as Lexan®, by virtue of its light weight, impact and heat resistance, and ease of cleaning. Alternatively, either the dome 4, base member 14, or both, can be constructed of glass, or an acrylic such as Plexiglass®. The base member 14 can also be constructed of wood, which has the advantage of low heat conduction, or of a metal such as brass, aluminum, or a steel alloy. The base member 14 is preferably heavier than the dome 4 to produce a low center of gravity to prevent unintentional tipping of the smoking device 2. The base member optionally contains a compartment (not shown) for storage of smokable materials, spare bowls 24, and other accessories.

The bowl 24 is preferably shallow and saucer-like in cross section, to provide even heating to a smokable material placed on its upper surface 26, but the bowl 24 can alternatively be of any concave form, or can be flat. The bowl 24 is preferably constructed of borosilicate glass, but can alternatively be constructed of any heat resistant material known in the art, for example a heat resistant metal such as titanium or brass. Preferably, the bowl 24 is removable from the socket 34 to facilitate cleaning, charging, and replacement of the bowl 24. To promote sealing engagement between the bowl 24 and socket 34, the collar 32 of the bowl 24 preferably has a tapered profile, and the socket 34 has a matchingly tapered profile. For example, the collar 32 tapers outward as it extends upward, and the socket 34 has a matching outward taper, as shown in FIGS. 1B and 1C. The exterior of the collar 32 is preferably roughened, for example by grinding or sand blasting, and the interior of the socket 34 is similarly roughened. These roughenings also promote tightness of fit and seal.

Alternatively, the bowl 24 can be sealingly engaged to the socket 34 by means of a screw lock mechanism mediated by the interaction of threads (not shown) on the collar 32 with complimentary threads (not shown) on the socket 34. The bowl 24 can also be sealingly engaged to the socket 34 by any suitable sealing means known in the art. The bowl 24 can alternatively be permanently sealed into the socket 34 or fabricated as a unit with the base member 14.

The lower surface 28 of the bowl 24 is preferably heated by means of an applied flame, as illustrated in FIG. 1B. Optionally, an electrical heating element of any type well known in the art (not shown), can be incorporated into the bowl 24 or applied to the lower surface 28 of the bowl 24.

The engagement of the dome 4 and the base member 14 is most readily accomplished by means of a simple gravity fit between the rim 12 of the dome 4 and ledge 20 of the base member 14. Alternatively, the base member 14 can include at least one groove (not shown) inscribed completely around the upper surface of the ledge 20, with the rim 12 of the dome 4 being insertable into the groove (not shown). This arrangement can enhance the stability of the fit between the dome 4 and the base member 14. As a further alternative, the rim 12 of the dome 4 can be extended exteriolaterally at selected points into a plurality of tongues (not shown) rotatable to engage complementary slots (not shown) defined in the ledge 20 of the base member 14. The dome 4 and base member 14 can also be engageable by a screw-twist mechanism, wherein spiral threads (not shown) defined on one side of the dome 4, engage complementary spiral threads (not shown) defined on the opposite side of the base member 14. Any suitable means of engagement known in the art can alternatively be employed.

The dome can additionally include a sealable hatch 46 preferably situated on a side wall 8 of the dome 4. The sealable hatch 46 allows a user to access to the bowl 24 without removing the dome 4 from the base member 14. An example of a sealable hatch 46 is the hatch 46 engaged by a hinge 48 to a side wall 8 of the dome 4 shown in FIG. 2B.

To operate the smoking device 2 of the present invention, a user inserts a bowl 24 into the socket 34 and places a smokable material, for example tobacco, on the upper surface 26 of the bowl 24. The user engages the dome 4 with the base member 14 and occludes both the choke 44 and the mouthpiece 40. Preferably, the choke 44 is occluded with a finger, and the mouthpiece is occluded either with a finger or by oral engagement by the user. The user then applies heat to the lower surface 28 of the bowl 24 to produce smoke or vapor. Preferably, heat is applied in the form of an open flame, such as that produced by a match or lighter. The user orally engages the mouthpiece 40, simultaneously uncovers the choke 44, and inhales through the mouthpiece 40. The user occludes the choke 44 once again at the end of the inhalation. If residual smoke remains in the interior space 22, the user either occludes the mouthpiece or maintains oral engagement with the mouthpiece as required to prevent escape of the smoke into the atmosphere. When operated in this manner, the smoking device 2 permits no smoke or vapor to escape into the atmosphere during the acts of heating and inhalation. The upper surface 26 of the bowl 24, which is the source of smoke or vapor, is completely isolated from the atmosphere during the smoking operation.

Alternatively, after a user places a smokable material, on the upper surface 26 of the bowl 24, and engages the dome 4 with the base member 14, the user applies heat directly to the smokable material on the upper surface 28 of the bowl 24. Preferably, heat is applied by extending a heat source through the choke 44 until it comes into sufficient proximity or contact with the smokable material to produce a desired amount of smoke or vapor. Exemplary heat sources for direct application to the smokable material include long-stemmed matches known in the art as fireplace lighters, and long-necked gas-fueled lighters known in the art as barbeque lighters. This method of operation is particularly facilitated by the embodiment of the bowl 24 wherein the upper surface 26 of the bowl 24 is elevated above the bottom wall 16 of the base member 14 by a column 29. Once the desired amount of smoke or vapor is produced, the user withdraws the heat source through the choke 44, occludes the choke 44, orally engages the mouthpiece 40, then simultaneously uncovers the choke 44 and inhales through the mouthpiece 40, occluding the choke 44 once again at the end of the inhalation. If residual smoke remains in the interior space 22, the user either occludes the mouthpiece or maintains oral engagement with the mouthpiece as required to prevent escape of the smoke into the atmosphere.

While illustrative embodiments of the invention have been disclosed herein, it is understood that other embodiments and modifications may be apparent to those of ordinary skill in the art.

REFERENCES

U.S. Pat. Nos.
4,165,753
4,253,252
5,678,573
7,905,236

The invention claimed is:

1. An enclosed smoking device comprising:

a base member;

a socket extending through said base member;

a bowl to contain a smokable material, said bowl having a solid bottom including an upper surface and a lower surface, said bowl being sealingly engageable with said socket, said lower surface of said bowl being exposed to the atmosphere when said bowl is sealingly engaged to said socket;

a dome sealingly engageable with said base member, said dome including a mouthpiece; and said base member, said upper surface of said bowl, and said dome defining an enclosed interior space isolated from the atmosphere, wherein said mouthpiece is further defined as a non-projection integrated mouthpiece occludable by a user.

2. The device as set forth in claim 1, wherein said dome further comprises a choke occludable by a user.

3. The device as set forth in claim 1, wherein said bowl is heatable by a heat source applied to said lower surface of said bowl.

4. The device as set forth in claim 1, wherein said bowl is heatable by a heat source applied to a smokable material upon said upper surface of said bowl.

5. The device as set forth in claim 1, wherein said bowl further comprises a lateral wall extending downward to form a circumferential collar to sealingly engage said bowl with said socket.

6. The device as set forth in claim 5, wherein said lateral wall of said bowl further comprises a column to elevate said upper surface of said bowl above said socket.

7. The device as set forth in claim 6, wherein said lateral wall is inwardly inflected to form a pedestal to support said column.

8. The device as set forth in claim 5, said collar having a tapered profile and said socket having a matchingly tapered profile.

9. The device as set forth in claim 1, wherein said dome is further defined as a cylinder having a top wall, and a circumferential side wall extending downward from said upper surface to form a rim, said base member having a shape sufficiently similar to that of said dome to promote close engagement with said dome.

10. The device as set forth in claim 1, wherein said dome is further defined as having a shape selected from the group consisting of a truncated sphere and a polygon, said base member having a shape sufficiently similar to that of said dome to promote close engagement with said dome.

11. The device as set forth in claim 1, wherein said dome is sealingly engageable with said base member by an engagement mechanism.

12. The device as set forth in claim 11, wherein said engagement mechanism is selected from the group comprising a gravity fit, a rim and groove fit, a tongue and slot fit, and a screw twist fit.

13. The device as set forth in claim 1, wherein said dome is tiltably attached to said base member by means of a hinge.

14. The device as set forth in claim 1, wherein said dome further includes a sealable hatch to facilitate user access to said bowl.

15. The device as set forth in claim 1, wherein said mouthpiece is situated at a vertex between said top wall and said side wall of said dome.

16. The device as set forth in claim 1, wherein said mouthpiece is surrounded by at least one raised lobe projecting from said dome.

17. The device as set forth in claim 1, wherein said mouthpiece is surrounded by at least one cushion.

18. A method for smoking a smokable material without escape of smoke or vapor into the atmosphere including the steps of:

sealingly engaging a bowl with a base member;

placing a smokable material on an upper surface of the bowl;

sealingly engaging with the base member a dome having a mouthpiece and a choke;

isolating the upper surface of the bowl from the atmosphere by occluding the mouthpiece and choke;

applying heat to a lower surface of the bowl;

producing smoke or vapor;

orally engaging the mouthpiece;

uncovering the choke;

inhaling through the mouthpiece;

occluding the choke at the end of inhalation; and preventing escape of any residual smoke by occluding the mouthpiece, wherein said mouthpiece is further defined as a non-projection integrated mouthpiece occludable by a user.

19. A method for smoking a smokable material without escape of smoke or vapor into the atmosphere including the steps of:

sealingly engaging a bowl with a base member;

placing a smokable material on an upper surface of the bowl;

sealingly engaging with the base member a dome having a mouthpiece and a choke;

extending a heat source through the choke;

applying heat to the smokable material;

producing smoke or vapor;

withdrawing the heat source;

isolating the upper surface of the bowl from the atmosphere by occluding the mouthpiece and choke;

orally engaging the mouthpiece;

uncovering the choke;

inhaling through the mouthpiece;

occluding the choke at the end of inhalation; and preventing escape of any residual smoke by occluding the mouthpiece.

* * * * *